US005711067A

United States Patent [19]

Jenner et al.

[11] Patent Number: 5,711,067

[45] Date of Patent: Jan. 27, 1998

[54] METHOD OF FORMING ELECTRICAL CONNECTOR

[76] Inventors: Royal Jenner, 7531 W. 175th St., Tinley Park, Ill. 60477; Antonio C. DiPaolo, 20 W. 481 Camder Dr., Downers Grove, Ill. 60516

[21] Appl. No.: 721,394

[22] Filed: Sep. 26, 1996

[51] Int. Cl.[6] ..... H01R 43/16

[52] U.S. Cl. ..... 29/874; 29/882; 439/396; 439/736

[58] Field of Search ..... 29/874, 882, 753; 439/396, 736

[56] References Cited

U.S. PATENT DOCUMENTS 3,977,754 8/1976 Brummans .
4,047,785 9/1977 Jayne .
4,964,812 10/1990 Siemon et al. .
5,409,404 4/1995 Reed .
5,591,045 1/1997 Pepe et al. .

*Primary Examiner*—Carl J. Arbes
*Attorney, Agent, or Firm*—Mark D. Hilliard; Robert A. McCann

[57] ABSTRACT

A wire connecting block for use in 110-style cross connect systems in which the contacts include a pair of oppositely directed tabs to secure the contact in the housing against a pair of oppositely directed ledges formed in the contact receiving slots. The connector is formed by a method that utilizes a punching operation to secure the contacts by the double tab locking arrangement as described.

5 Claims, 3 Drawing Sheets

METHOD OF FORMING ELECTRICAL CONNECTOR

TECHNICAL FIELD

The present invention relates to an electrical connector and more particularly to an improved wire connecting block including a plurality of parallel slotted beam type contacts for a 110-style cross connect system in which the connector structure and manufacturing method provides for an easier to assemble connector having a one piece connector body.

BACKGROUND OF THE INVENTION 110-style cross connect wiring systems are well known and are often seen in wiring closets terminating a large number of incoming and outgoing wiring systems. Cross connect wiring systems commonly include wiring strip panels on wiring blocks which terminate individual wires from cables and interconnect with 100-style punch down wire connecting blocks that are subsequently interconnected with patch cord connectors. The 100-style wire connecting blocks have a dielectric housing containing a plurality of double ended slotted beam insulation displacement contacts that interconnect at one end with a plurality of wires on the wiring blocks and a flat beam contact portion of a patch cord connector at the opposite end. While the different existing 100-style wire connecting blocks are generally interchangeable, many of the prior connecting blocks have involved two-piece housing assemblies which are more complicated to make and more difficult to assemble. There are existing 100-style connector designs utilizing a one piece housing such as the electrical connector shown in U.S. Pat. No. 5,409,404 to Reed and assigned to The Whitaker Corporation. However, these designs include draw backs such as requiring additional and more complicated assembly steps. Therefore, improvement in the art of manufacturing 100-style wire connecting blocks is still necessary.

SUMMARY OF THE INVENTION

It is therefore, an object of the present invention to provide an improved 100-style wire connecting block.

It is further an object of the present invention to provide an improved method of manufacturing a 100-style wire connecting block.

In general a connecting block of the present invention includes a dielectric housing, and a plurality of slotted beam contacts situated within a plurality of contact receiving slots formed through the housing, wherein the contacts include a pair of sheared tabs opposingly directed to engage against a pair of oppositely directed ledges formed adjacent the contact receiving slots so as to secure said contacts within the housing and is formed by a method including the steps of providing a connector housing having a plurality of contact receiving slots including a first ledge and a second oppositely directed ledge both formed adjacent the contact receiving slots, shearing a pair of oppositely directed tabs on to a single side of a central portion of a planar contact, forming one of the sheared tabs into plane with the contact, inserting said contact into said contact receiving slot of the housing until the remaining tab abuts against the first ledge, and punching through an opening formed in the housing to form the second sheared tab on a second side of the contact relationship to the second ledge.

DESCRIPTION OF THE PREFERRED EMBODIMENT

Figures 1, 2:
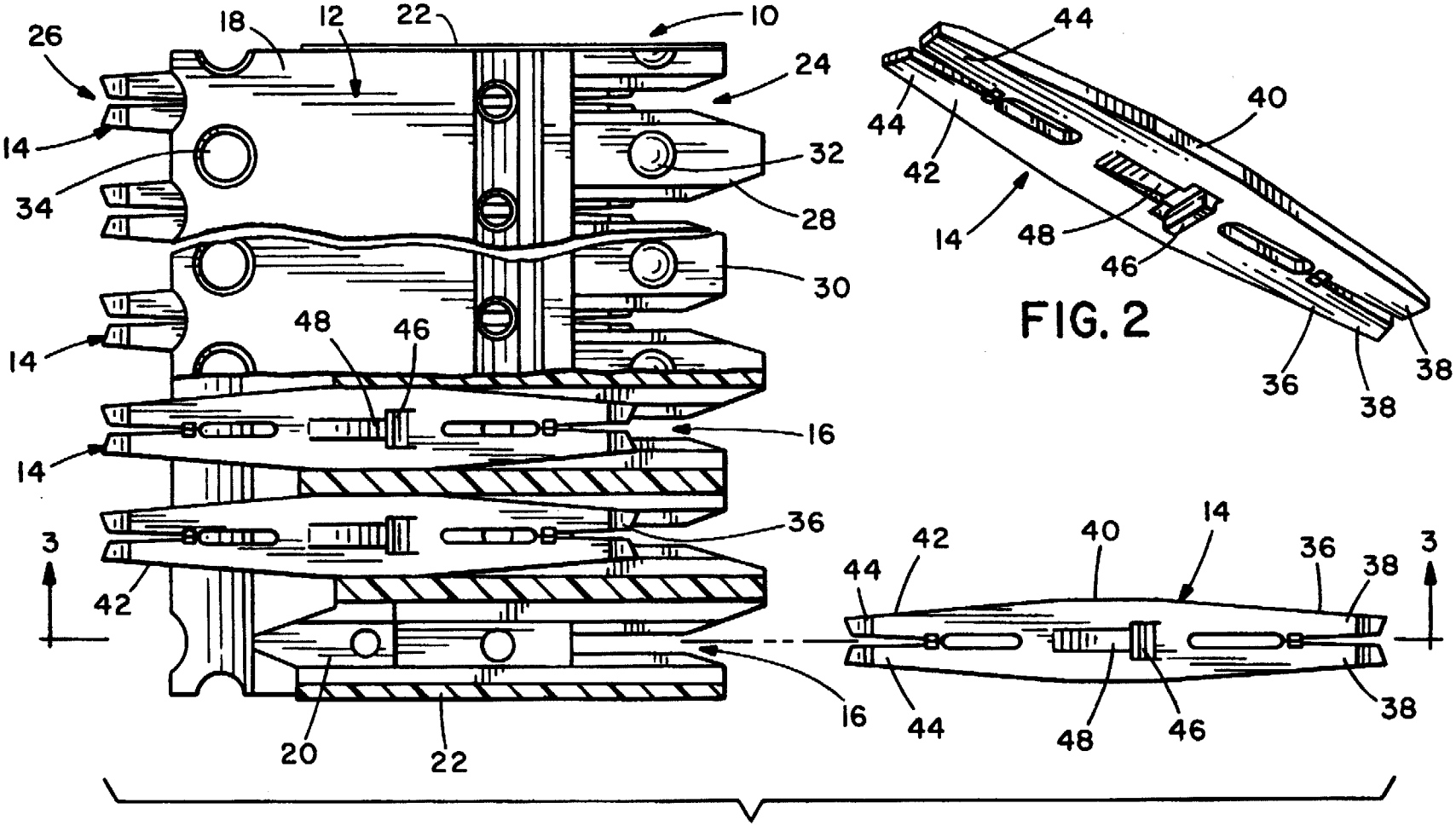
FIG. 1 is a partially fragmented plan view of the punch down connector of the present invention.
FIG. 2 is a perspective view of a contact of the punch down connector of FIG. 1.

An electrical connector embodying the concept of the present invention is designated generally by the reference numeral 10 in the accompanying drawings. As shown in FIG. 1, the 100-style wire connecting block is comprised of a one-piece housing section 12 and a plurality of generally planar double ended slotted beam IDC contacts 14.

The connector housing 12 is made of a dielectric material and is formed by molding to include first and second sidewalls 18, 20 and a pair of endwalls 22 surrounding a plurality of contact receiving slots 16 for supporting a plurality of contacts 14 as shown in FIG. 1. The standard 100-style connector has a patch cord end 24 which connects to a patch cord connector (not shown) and a wire strip end 26 which connects to an index strip or a wiring block (not shown) of the cross connect system. The patch cord end 24 includes upper teeth 28 and lower teeth 30 which are used to mate with the corresponding geometry of a patch cord connector. Both the upper and lower teeth 28, 30 include arcuate projections 32 which mate with complementary recesses formed on the patch cord connector. The wire strip end 26 includes arcuate recesses 34 which are engaged by complementary projections on the wiring block.

The standard 100-style connector contacts are double ended slotted beam IDC contacts. It is to be noted that other well known types of contacts could be utilized. As can be seen in FIG.2, both a first end of the contact 36 and a second end 42 include a pair of tines forming a slotted beam IDC contact portion 38,44.

Figure 3:
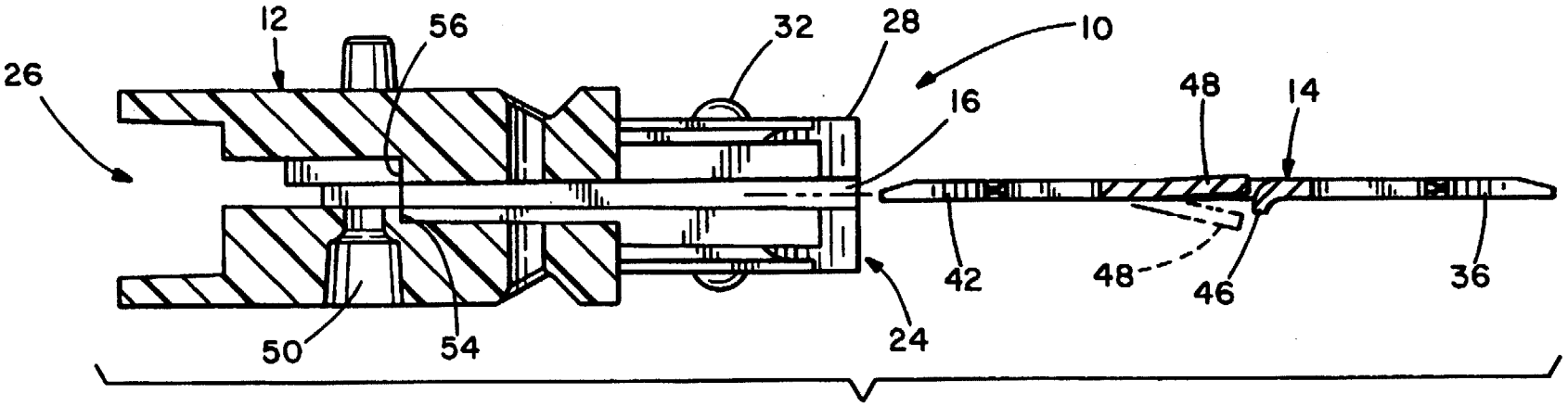
FIG. 3 is a side section view of the connector housing and contact prior to assembly.
Figure 4:
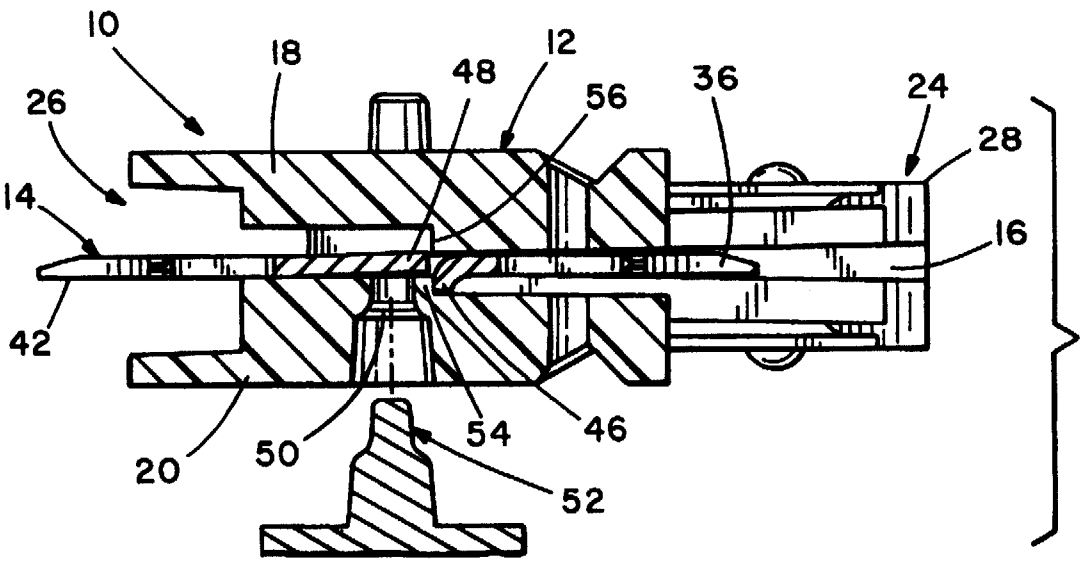
FIG. 4 is a side section view of the connector housing with the contact partially assembled.
Figure 5:
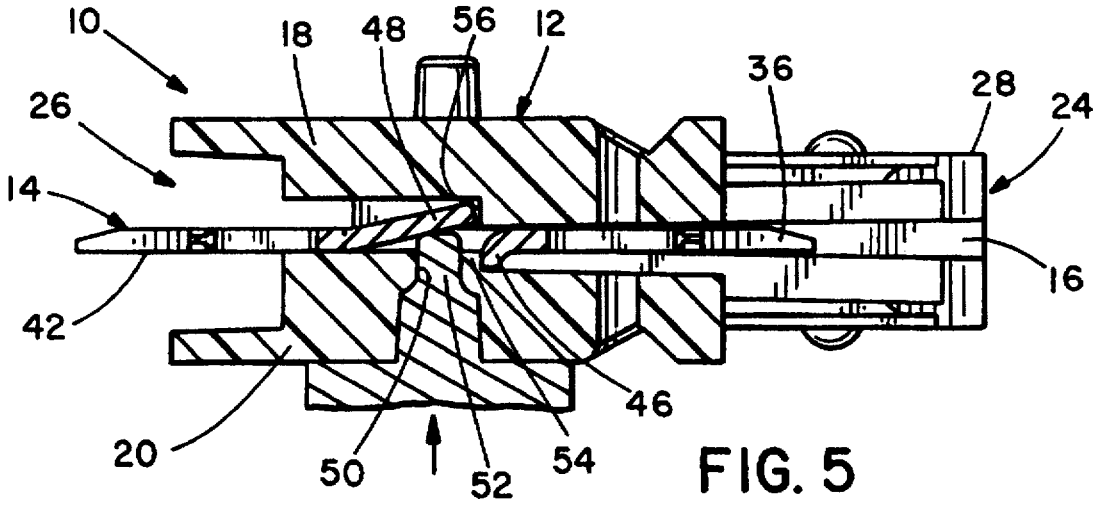
FIG. 5 is a side section view of the wire connecting block showing the punching operation.
Figure 6:
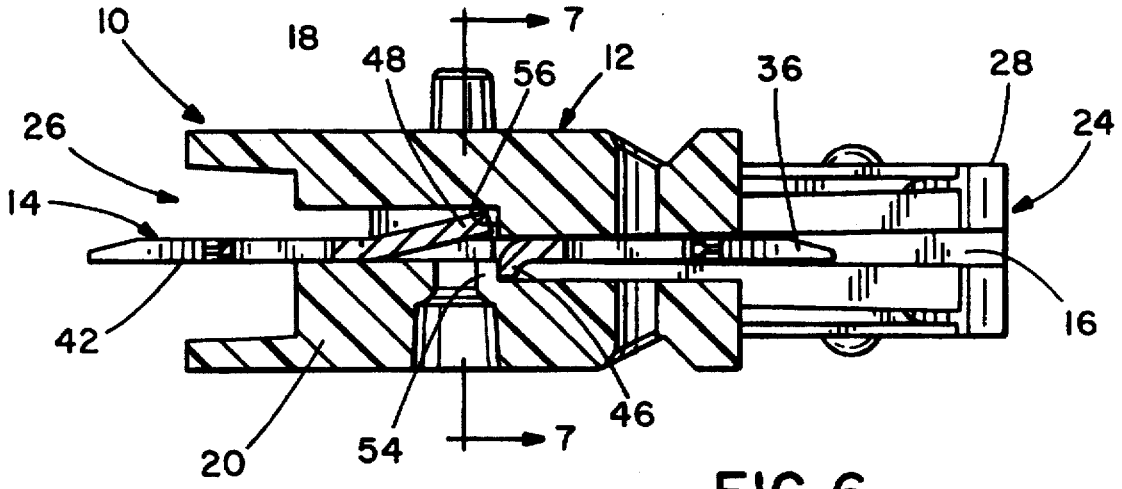
FIG. 6 is a side section view of the wire connecting block after the punching operation.
Figure 7:
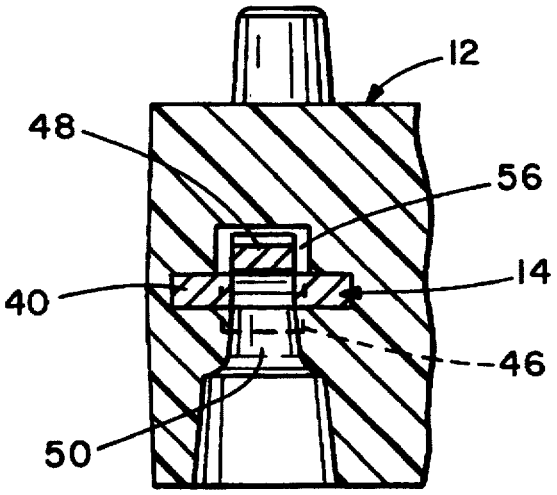
FIG. 7 is a sectional view taken along lines 7—7 of FIG. 6.

As best seen in FIGS. 3 and 4, the housing body 12 of the present invention is also formed to include a pair of internal ledges 54, 56 formed adjacent the contact receiving slots on opposing sidewalls and facing opposing ends of the connector 10.

The contacts of the present invention are initially formed by shearing two tabs out of a center portion of the contact. As shown in FIG. 3, the two tabs, namely a shorter stop tab 46 and a longer retaining tab 48 are initially formed on the same side of the contact but in opposing vertical directions (longer tab in phantom). It is to be noted that the direction of the tabs during the initial shearing could also be formed on opposing sides of the contact. The retaining tab 48 is then formed back to be disposed nearly flat with respect to the plane of the contact 14. Contact 14 is then inserted into the connector housing 12 from the patch cord end with the stop tab facing inward, until the stop tab 46 abuts against the stop ledge 54. The retaining tab 48 is then formed by a punching operation in the opposite direction until it abuts against the retention ledge. The housing 12 includes punch openings 50 which are aligned with the retaining tab 48 when stop tab 46 is abutting stop ledge 54. Therefore, the contacts are retained securely in both directions within the connector body.

While the particular preferred embodiment of the present invention has been shown and described, it will be obvious to those skilled in the art that changes and modifications may be made without departing from the teachings of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A method of forming an electrical connector comprising the steps of:

providing a connector housing having a plurality of contact receiving slots including a first ledge and a second oppositely directed ledge both formed adjacent the contact receiving slots;

shearing a pair of oppositely directed tabs on to a central portion of a planar contact;

forming one of the sheared tabs into plane with the contact;

inserting said contact into said contact receiving slot of the housing until the remaining tab abuts against the first ledge; and punching through an opening formed in the housing to form the second sheared tab in abutting relationship to the second ledge.

2. A method of forming an electrical connector according to the method of claim 1, wherein the step of shearing a pair of oppositely directed tabs includes shearing the tabs on opposite sides of the contact.

3. A method of forming an electrical connector comprising the steps of:

providing a connector housing having a plurality of contact receiving slots including a first and a second oppositely directed ledges formed adjacent the contact receiving slots;

shearing a contact to form a stop tab on a central section;

inserting said contact into said contact receiving slot of the housing until the stop tab abuts against the first ledge; and punching through an opening formed in the housing to form a second sheared tab in abutting relationship to the second ledge.

4. A method of forming an electrical connector according to the steps of claim 3, wherein the step of shearing the contact includes shearing a second oppositely directed tab on the same side of the contact and then forming the second tab into a substantially planar relationship to the contact.

5. A method of forming an electrical connector according to the steps of claim 3, wherein the step of shearing the contact includes shearing a second oppositely directed tab on a side of the contact opposite to the first sheared stop tab and then forming the second tab into a substantially planar relationship to the contact.

* * * * *